US009784180B2

(12) United States Patent
Gorth

(10) Patent No.: US 9,784,180 B2
(45) Date of Patent: Oct. 10, 2017

(54) APPARATUS AND METHOD FOR AN ARTICULATING INNER STRUCTURE OF AN ENGINE CHAMBER

(71) Applicant: Steve Gorth, Charlotte, NC (US)

(72) Inventor: Steve Gorth, Charlotte, NC (US)

( * ) Notice: Subject to any disclaimer, the term of this patent is extended or adjusted under 35 U.S.C. 154(b) by 276 days.

(21) Appl. No.: 14/477,776

(22) Filed: Sep. 4, 2014

(65) Prior Publication Data

US 2016/0069257 A1 Mar. 10, 2016

(51) Int. Cl.

| | |
|---|---|
| ***F02B 75/32*** | (2006.01) |
| ***F02B 53/12*** | (2006.01) |
| ***F02B 53/04*** | (2006.01) |
| ***F02B 53/02*** | (2006.01) |
| ***F01B 19/02*** | (2006.01) |
| ***F01B 9/06*** | (2006.01) |
| ***F02B 75/36*** | (2006.01) |

(52) U.S. Cl.

CPC ..... *F02B 75/32* (2013.01); *F01B 9/06* (2013.01); *F01B 19/02* (2013.01); *F02B 53/02* (2013.01); *F02B 53/04* (2013.01); *F02B 53/12* (2013.01); *F02B 75/36* (2013.01)

(58) Field of Classification Search

None

See application file for complete search history.

(56) References Cited

U.S. PATENT DOCUMENTS

| | | | | |
|---|---|---|---|---|
| 3,614,277 | A * | 10/1971 | Kobayashi | F01C 1/3446 418/253 |
| 4,181,481 | A * | 1/1980 | Jordan | F01C 1/44 123/241 |
| 7,178,502 | B2 * | 2/2007 | Okulov | F01C 1/10 123/241 |
| 7,431,007 | B2 | 10/2008 | Kamath | |
| 8,904,991 | B2 * | 12/2014 | Al-Hawaj | F02B 55/14 123/200 |
| 2006/0065228 | A1 | 3/2006 | Pelrine et al. | |
| 2011/0297117 | A1 | 12/2011 | Reisser | |

* cited by examiner

*Primary Examiner* — Sarah McPartlin

(57) ABSTRACT

An apparatus and a method comprises a housing comprising at least a recessed area and an inner wall. A plurality of plates are disposed within the housing and configured to form a structure. The structure has an outside surface. The structure is capable of being articulated between a first configuration and a second configuration and a third configuration. A plurality of connecting rods are joined to the plurality of plates to form the structure and to at least in part articulate the structure. The connecting rods are movable to form the first configuration to enable a gas to flow from the recessed area to the outside surface. The plurality of connecting rods are further movable to form the second configuration, wherein at least a portion of the gas is compressed between the outside surface and the inner wall and then to the third configuration.

12 Claims, 4 Drawing Sheets

APPARATUS AND METHOD FOR AN ARTICULATING INNER STRUCTURE OF AN ENGINE CHAMBER

CROSS-REFERENCE TO RELATED APPLICATIONS

Not applicable.

RELATED CO-PENDING U.S. PATENT APPLICATIONS

Not applicable

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to engines. More particularly, the invention relates to an engine chamber comprising an articulating inner structure.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Due to the large number of moving parts and variables involved in the operation of typical internal combustion engines (ICE's), one may expect that some inefficiencies may arise, which may reduce performance. Some of these inefficiencies may be caused by the position of the crankshaft relative to when peak combustion pressures are experienced in the engine chamber. It is believed that an optimal position for the crankshaft when peak combustion pressures are experienced in the chamber of a typical ICE may be approximately 74 degrees from top dead center (tdc). However, some existing ICE's may not be configured to achieve this. For example, without limitation, peak combustion pressures in gasoline powered ICE's typically occur when the rotation of the crankshaft reaches approximately 11 degrees after tdc and are typically spent at about 25 degrees after tdc. Diesel powered ICE's may be implemented so that the crankshaft rotation is in a more optimal position for peak combustion pressures, hence their higher torque values as compared to gasoline engines. Still, crankshafts in diesel engines are generally not positioned near 74 degrees after tdc during peak combustion pressures where optimum torque may be achieved. An illustrative example of torque verses crankshaft position follows. A user is pedaling a bicycle and stops his weight at 25 degrees from tdc, which would be about one o'clock if tdc is the highest position of the pedal or 12 o'clock. In this scenario, one may expect that the user could not use the full leverage of the complete stroke of the pedal, which may make it difficult to pedal and move the bicycle.

By way of educational background, an aspect of the prior art generally useful to be aware of is that engines are currently available with many different configurations. For example, without limitation, engines may be implemented with various different numbers of strokes per cycle such as, but not limited to, two stoke engines or four stroke engines. Some engines may be arranged to shift between being used as a one stroke engine and a two stroke engine. Furthermore, the shapes of engine chambers may vary.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic top view of the articulating structure in a position of maximum inner volume. FIG. 1B is a diagrammatic top view of the articulating structure in a vertically oriented position of minimum inner volume, and FIG. 1C is a diagrammatic top view of the articulating structure in a horizontally oriented position of minimum inner volume;

Figure 1A:
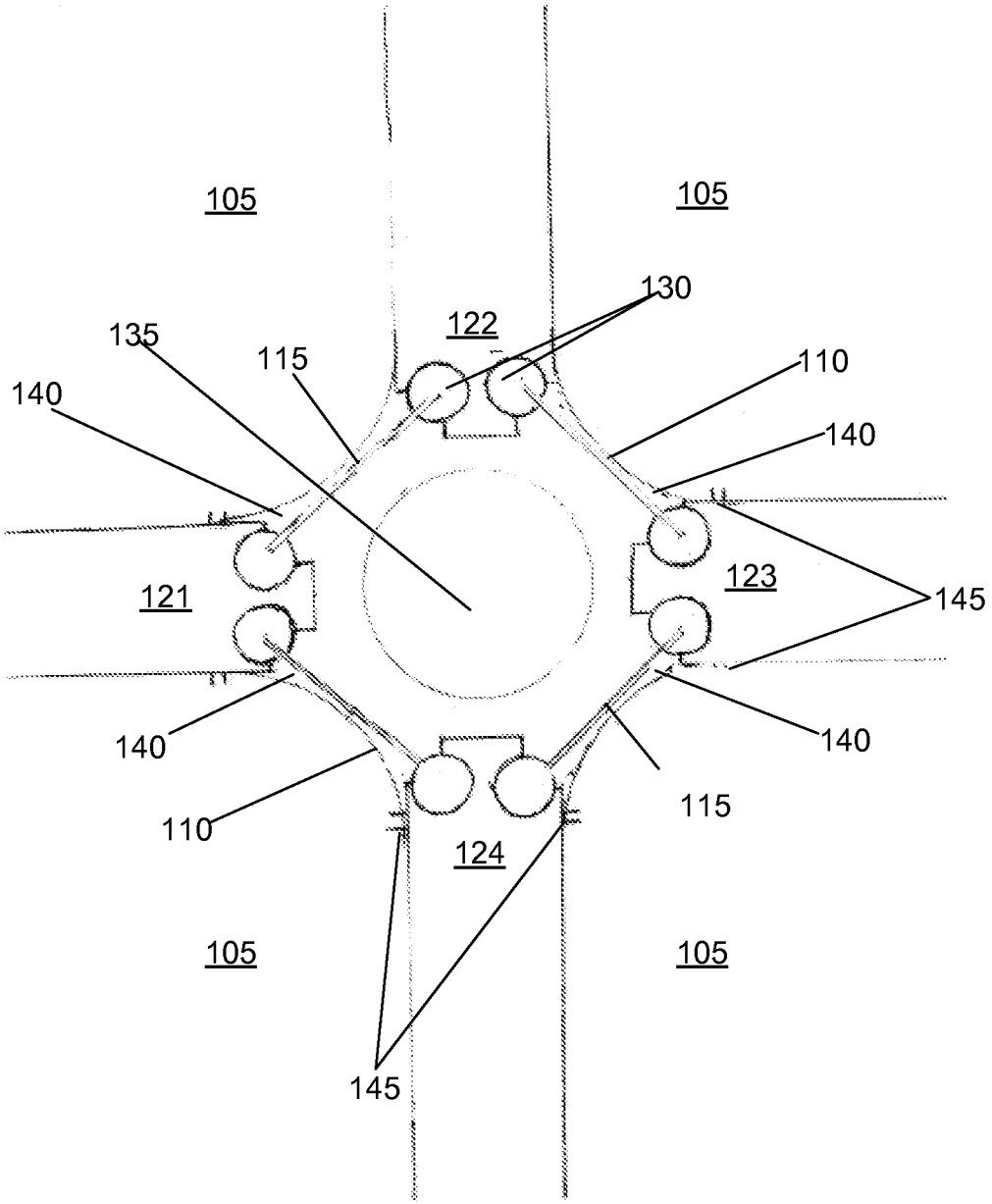
FIGS. 1A, 1B, and 1C illustrate an exemplary ICE combustion chamber with an articulating structure, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may describe a method or process for providing a reciprocating internal combustion engine (ICE) that may utilize an articulating structure within a confined combustion chamber. In some embodiments the use of an articulating geometrical structure may enable the structure to change in volume, size, shape and plane of movement. In one embodiment the plane of movement of the articulating structure at the termination of a stroke with 180 degrees of crankshaft or camshaft rotation may be substantially perpendicular to the original shape of the structure. The movement of the structure in this embodiment may capitalize on the apex of mechanical advantage of an attached crankshaft or camshaft. In some embodiments the movement of the articulating structure may be homeomorphic, meaning the change in shape of the structure may be a continuous deformation between two topological spaces whose inverse deformation is also continuous. Alternate embodiments may be configured with an articulating structure that does not follow a homeomorphic movement.

Figure 1B:
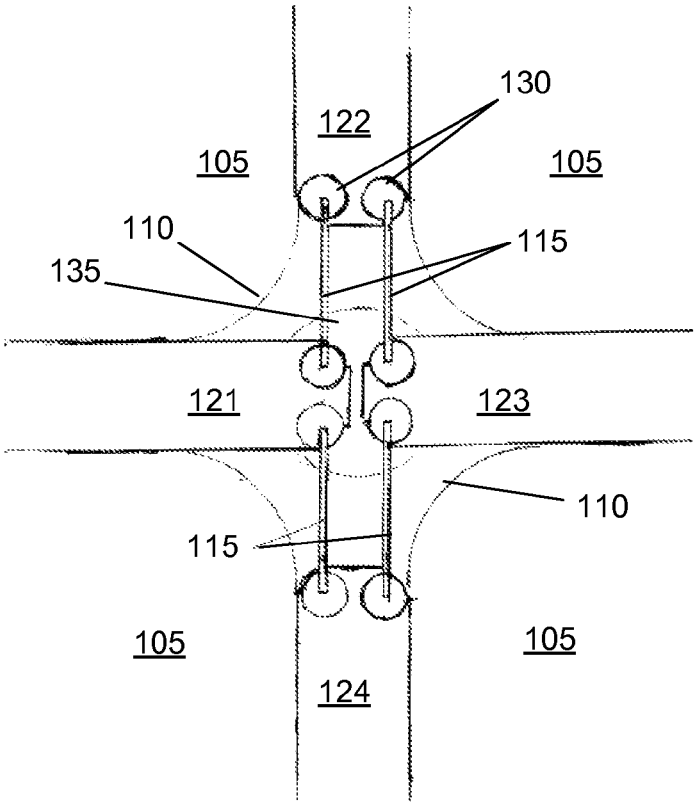
Figure 1C:
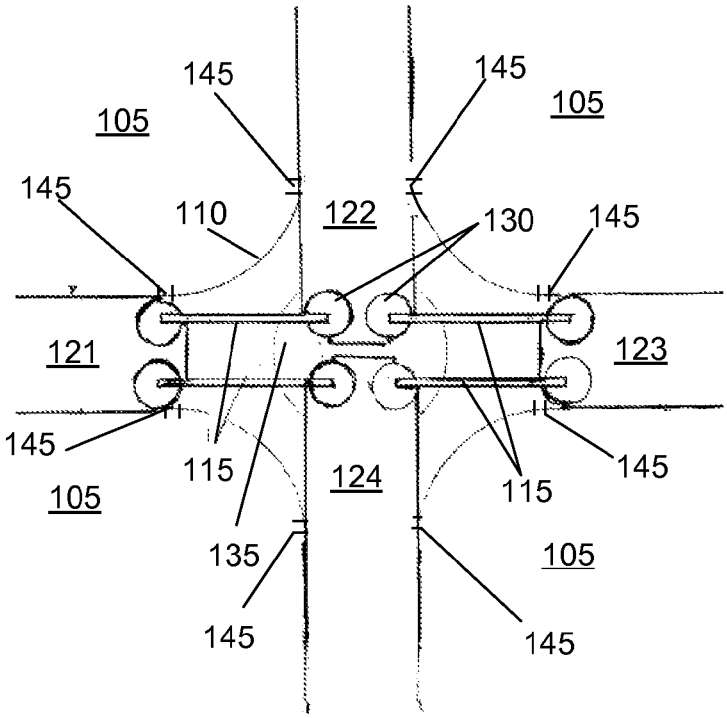

FIGS. 1A, 1B, and 1C illustrate an exemplary ICE combustion chamber with an articulating structure, in accordance with an embodiment of the present invention. FIG. 1A is a diagrammatic top view of the articulating structure in a position of maximum inner volume. FIG. 1B is a diagrammatic top view of the articulating structure in a vertically oriented position of minimum inner volume, and FIG. 1C is a diagrammatic top view of the articulating structure in a horizontally oriented position of minimum inner volume. In the present embodiment, the chamber comprises a housing 105 that may be shaped similarly to a two road, perpendicular intersection with curved outer corners 110. Curved corners 110 may facilitate the movement of power plates 115. Each power plate 115 typically moves around the radius of the length of the center of the power plate and alternates between a vertical position and a horizontal position. The height and width of the openings in housing 105 may be slightly larger than the dimensions of power plates 115 to allow for freedom of movement of power plates 115 and attached connecting rods 121, 122, 123, and 124 when a cover is attached to housing 105 to enclose the chamber. Connecting rods 121, 122, 123, and 124 may be lineally opposed in pairs and confined by power plates 115, which may be curved and/or bent to adjust compression ratios. The compression ratio is usually determined by calculating the ratio of the volume of the combustion chamber at its largest capacity to the volume of the chamber at its smallest capacity. Power plates 115, which act similarly to pistons, may be attached to connecting rods 121, 122, 123, and 124 by eight wrist pins 130 that may enable power plates 115 to articulate 90 degrees within connecting rods 121, 122, 123, and 124. Two wrist pins 130 may be attached to each power plate 115, one at each end, and may be housed and confined in connecting rods 121, 122, 123, and 124, which may be confined in housing 105. It is contemplated that various different types of attachment means may be used in some embodiments to connect the power plates to the connecting rods such as, but not limited to, hinges, ball and socket joints, finger joints, roller joints, etc., and geometrically confined pivot areas without the need for direct attachment because of the machine's structural geometries will contain movable components. In some embodiments the power plates 115, and wrist pins 130, maybe made as one part, incorporating both functions. In the present embodiment, connecting rods 121, 122, 123, and 121 may be linked radially by power plates 115 to form a flexible geometric structure. Referring to FIG. 1B, when connecting rods 121 and 123 move inward, connecting rods 122 and 124 typically move outward and perpendicular to inward moving connecting rods 121 and 122. Similarly, referring to FIG. 1C, when connecting rods 122 and 124 move inward, connecting rods 121 and 123 move outward and perpendicular to connecting rods 122 and 124.

Referring to FIG. 1A, housing 105 comprises a centralized recessed area 135 which may act as a conduit for fresh air by way of an intake or reed valve. In typical use of the present embodiment, the valve typically opens as the power plate structure is enlarging, which may allow air and fuel, herein referred to as mixture, into the chamber if needed. As the structure is expanding, the mixture in the chamber is pushed outward by power plates 115 and compressed between the inner surface of housing 105 and the outer surface of power plates 115 in compression areas 140. In some embodiments, side seals for the power plates 115 and connecting rods 121, 122, 123, and 124 may be composed of similar or like alloys that are used in conventional piston ringed or rotary designed engines. The seals if needed, and their locations, may be designed for the machine's end usage and engineered accordingly to help control leakage between chambers of different desired pressures. Referring to FIGS. 1B and 1C, the mixture is released into the chamber by the positioning of power plates 115 over recessed area 135. This recessed area 135, may be pressurized by the prior firing cycle of 140. Once recessed area 135 location is breached by the power plates 115, the pressurized mixture may flow or discharge, above or below the power plates 115, and seals if so contained. This flow or discharge of mixture may aid in the evacuation of spent gases via the ports 145 on the connecting rods, from combustion area 140, and charging same with a fuel mixture ready for firing. As a non-limiting example, an electric or mechanical intake valve, one way valve, reed valve or check valve, etc., may allow fresh air to enter the recessed area 135, from an area on the main housing or housing cover or from any other area that is suitable. The incoming mixture drives out any spent combustion gases remaining in compression areas 140 through exhaust ports 145 on both sides of each connecting rod. Referring to FIG. 1C, exhaust ports 145 are positioned so that exhaust ports 145 near extended connecting rods 121 and 123 are unobstructed to typically enable the incoming mixture to displace spent combustion gases through. Then, referring to FIG. 1A, connecting rods 121, 122, 123, and 124 are moved by stroke movement until all connecting rods are equidistant from each other and compression area 140 is ready for firing. In this position, connecting rods 121, 122, 123, and 124 cover all of exhaust ports 145 so that the mixture remains in compression area 140 for combustion. It is a very well established process that in conventional gasoline ICE's, the explosion of the fuel mixture from an ignition source, and therefore the heat created by combustion, causes the gases in the combustion chamber to obey standard rules of chemistry such as, but not limited to, the Ideal Gas Law. Because of the sudden heat, the gases try to expand immediately, but they cannot, so the pressure in those hot gases greatly and rapidly increases. Very consistently, the explosion pressure in an internal combustion engine rises to between 4 and 5 times the initial compression pressure. The present invention uses the same process to move the power plates 115, inward, and allow the structure to change in shape as shown in FIG. 1A, to either shape shown in FIG. 1B or FIG. 1C, depending upon the rotational direction of the flywheel 215, and its stored inertia to initialize the reciprocating cycle. Some embodiments may also comprise pressure equalization holes or grooves in the housing or connecting rods that connect the separate portions of compression area to help equalize the combustion pressures in all portions of compression area. In the present embodiment, the expansion of power plates 115 typically compresses the mixture in compression area 140 similarly to the compression of a mixture in a conventional ICE when the crankshaft is at tdc on a compression stroke. However, in the present embodiment, the compression typically occurs at a half stroke when the crankshaft or camshaft may be positioned at a maximum distance from the center of rotation, which may take advantage of the geometry of the crankshaft or camshaft to aid in the development of torque and horsepower. Unlike a piston that is fixed in surface area found in conventional ICE's, the articulating structure of the present embodiment may be able to increase in surface area as it is moved, which may result in capturing more of the available energy as pressures drop from motion and the end of combustion. It is further contemplated that the use of the present embodiment may increase fuel efficiency and power considerably. By changing in shape in one cycle or stroke from a vertical rectangle and then to a square and then to a horizontal rectangle in a predefined chamber, the present embodiment may provide compression and evacuation in a single stroke.

Typically a flywheel is a rotating structural device that is used to store rotational energy. Camshafts, though initially designed as a method of creating reciprocating motion for valve actuation or other mechanical switching devices, may also store rotational energy and be used as a method of converting reciprocating motion to rotary motion in a manner similar to a crankshaft. Flywheels and other rotating structural devices as previously described, have a significant moment of inertia and thus resist changes in rotational speed. The amount of energy stored in a flywheel is proportional to the square of its rotational speed. Energy is transferred to a flywheel, camshaft, or crankshaft, by applying torque to it, thereby increasing its rotational speed, and hence its stored energy. Conversely, a flywheel, camshaft, or crankshaft, releases stored energy by applying torque to a mechanical load, thereby decreasing its rotational speed under certain conditions. This may enable a camshaft or crankshaft to be used to its fullest torque potential when used in an internal combustion engine, a compressor, a pump, a motor, an air motor, a wave and tide electrical generation device, a robotic movement device, etc. In some embodiments the change of shape of the structure may occur in less than one cycle or over multiple cycles. Those skilled in the art will readily recognize, in light of and in accordance with the teachings of the present invention, that a multiplicity of suitable geometrically changing, reciprocating configurations may be used to enable volumetric increases and decreases to occur in a confined chamber or chambers in a similar manner. For example, without limitation, articulating structures may be implemented in various different reciprocating shapes such as, but not limited to, rectangles that expand into circles or ovals, triangles that expand into diamonds or rectangles, etc. Other alternate embodiments may be implemented with more or fewer connecting rods. For example, without limitation, one such embodiment may comprise two connecting rods pivotally attached to four power plates, with two power plates on each rod. The free ends of the power plates on one connecting rod may be pivotally attached to the free ends of the power plates on the other connecting rod to create a square or rectangle shape. This shape may reciprocate from the rectangular shape to a narrow diamond shape to decrease the inner volume by moving the connecting rods toward each other and then may return to the original rectangular shape by moving the connecting rods away from each other to increase the inner volume.

Figure 2:
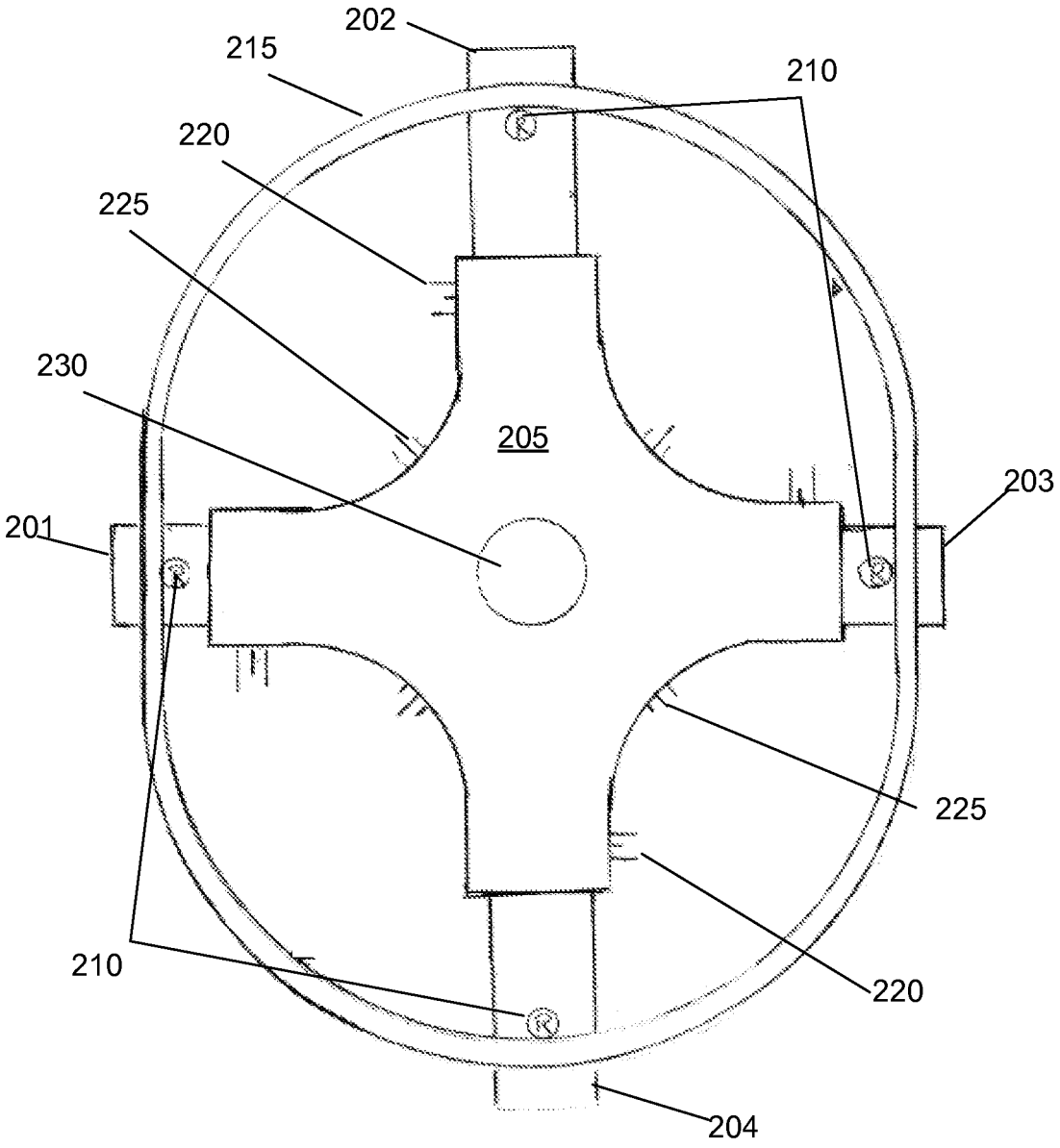
FIG. 2 is a diagrammatic top view of an exemplary combustion chamber housing, in accordance with an embodiment of the present invention.

FIG. 2 is a diagrammatic top view of an exemplary combustion chamber housing 205, in accordance with an embodiment of the present invention. In the present embodiment, four connecting rods 201, 202, 203, and 204 protrude from main housing 205. Rollers 210 on each connecting rod may be in contact with an oval flywheel 215 to provide rotary motion. Typically the crankshaft is the working arm of most ICE engines. In the present embodiment, flywheel 215 with an internal eccentric continuous lobe, serves the same purpose as a crankshaft. The force generated by combustion and the inward motion and outward movement of the power plates 115 is focused on the crank throws, or the off-set distance of the eccentric to that of a circle. Rotation of this flywheel may cause the internal structure to move via the connecting rods and also during combustion to continue rotary motion by the cyclic movement of the structure. The leverage effect of the force exerted on the internal eccentric continuous lobe, twists the flywheel around its central axis and converts the reciprocating motion of the connecting rods into rotational motion of flywheel 215. The rotating mass of flywheel 215 also creates inertia and momentum that keeps everything spinning. This gives the flywheel enough energy to push the power plates into position for compression and exhaust strokes, and to pull air and fuel into the chambers or other processes as needed. In some embodiments a compression release valve may be used during initial starting and then closed when significant energy is stored in flywheel 215 to start initial combustion.

In some embodiments a flywheel or one or more connecting rods may be in contact with a cam, a camshaft, or a crankshaft to convert the reciprocal motion into rotary motion. In the present embodiment, all four connecting rods 201, 202, 203, and 204 are shown protruding from housing 205 for illustration and balance. However, in some embodiment only one connecting rod may be needed to protrude from the housing to run a flywheel, cam, or crankshaft to convert reciprocating motion to rotary motion. Any remaining connecting rods may be used for a variety of other functions such as, but not limited to, as guides, for compression, for controlling evacuation, for combustion, to generate electrical power, for matter movement, etc. In some alternate applications, reciprocal motion may be the desired output, including, without limitation, in pumps, in a reciprocating saw, to open and close sliding valves, etc. In these embodiments one or more of the connecting rods may be attached directly to the element that is meant to move in a reciprocating motion. In some embodiments, reciprocating structure within the chamber may also be designed for combustion. Some embodiments may be an internal combustion engine or an external combustion engine, like a steam engine that has a boiler or a nuclear power station that drive turbines and then the pressurized steam is ported. Some embodiments may incorporate connecting rods that are part of the firing chamber, for increased compression ratios, for dieseling if desired. The geometry of the present invention may allow for multiple peripheries to be incorporated. In the present embodiment, housing 205 comprises exhaust ports 220 to allow for the release of spent combustion gases and four spark-plug holes 225 that are aligned with the compression areas inside housing 205. Spark plugs or other types of igniters may be placed in or near spark plug holes 225, which may provide a spark or flame to ignite the mixture in the compression areas for combustion. In some embodiments, hollow or tube type connecting rods may be used for porting exhaust gases or other matter. An air intake port 230 may be located on one or both sides of housing 205 if needed for providing oxygen to the fuel mixture to aid in combustion.

A multiplicity of suitable materials may be used for construction of the various parts of including, but not limited to, alloys of iron or aluminum, cast iron, forged steel, etc. Materials other than metals may also be used in construction; for example, without limitation, tungsten carbide or a similar composite material or ceramic may be well suited for applications operating at high temperatures because of the low thermal expansion properties held by many of these types of materials. Those skilled in the art will readily recognize, in light of and in accordance with the teachings of the present invention, that the housing design may vary in some embodiments depending on factors such as, but not limited to, the desired compression ratios, the size and shape of the articulating inner structure, ease of movement of the inner structure, fuel type, etc. Similarly, the size and shape of the connecting rods and power plates may also vary and may be designed for specific compression ratios, applications, power plate configurations, etc. For example, without limitation, square or round solid rod or hollow tubing may be used for the connecting rods, the thickness of the power plates may increase or decrease depending on the amount of pressure in the system, the edges of the power plates may be rounded for ease of movement, etc. The present embodiment illustrates four connecting rods to drive flywheel 215. In some embodiments, one connecting rod may be used to drive a crankshaft with or without a flywheel and the other connecting rods used for additional mechanical operations such as but not limited to, air, gas compression, evacuation, fluid pumping, electrical generation, etc. In addition, some embodiments of the present invention may employ, but not limited to, various different fuel types and delivery, cooling means, air intake means, lubrication types, exhaust porting or valving, compression release means, starting and ignition, etc. For example, without limitation, water may be used as a substitute for fuel for several cycles to create a motor fully or partially powered by steam, and it is believed that the combination of a fuel and steam engine may be highly efficient. Some embodiments may use a fuel lubricant combination.

Figure 3:
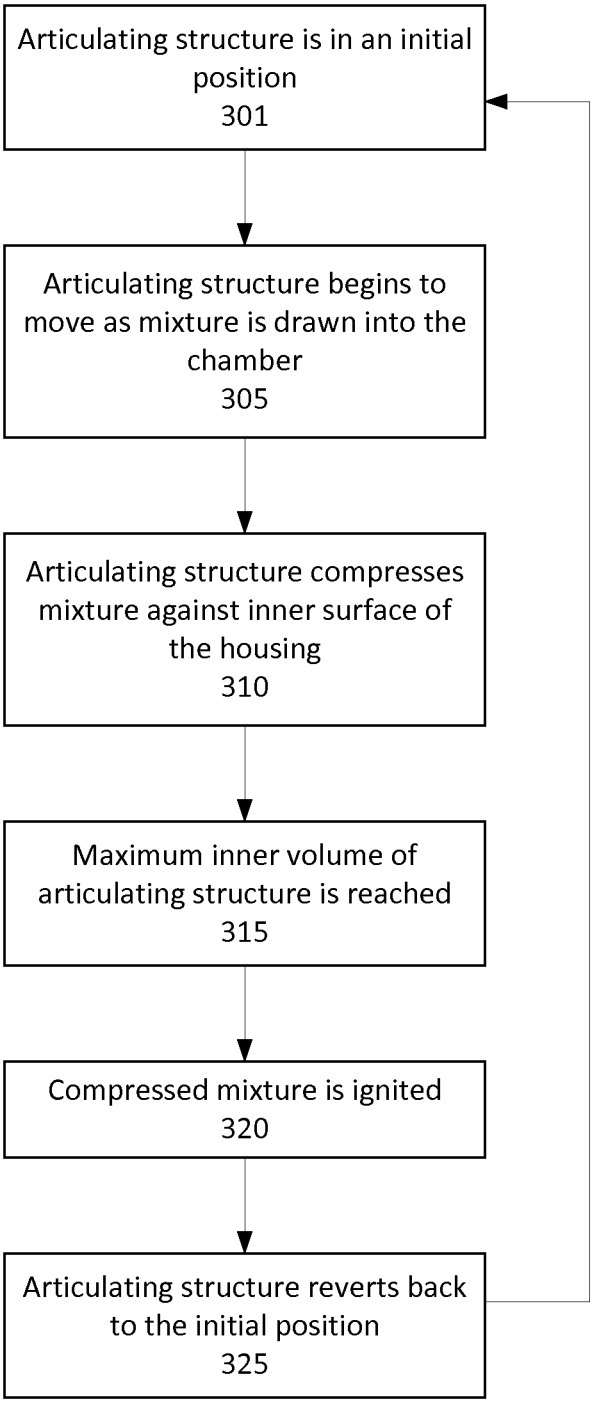
FIG. 3 is a flowchart illustrating an exemplary process for producing reciprocating motion using an articulating structure in a confined combustion chamber, in accordance with an embodiment of the present invention.

FIG. 3 is a flowchart illustrating an exemplary process for producing reciprocating motion using an articulating structure in a confined combustion chamber, in accordance with an embodiment of the present invention. In the present embodiment, a cycle begins with the articulating structure in an initial position in step 301, FIG. 1B. Then, in step 305, the articulating structure begins to move as an air and fuel mixture is drawn into the chamber. The movement of the articulating structure typically aims to decrease the volume between the outer surface of the articulating structure and the inner surface of the housing of the combustion chamber. In step 310, the articulating structure continues to move, which may compress the mixture within the area between the housing and the articulating structure, until the articulating structure reaches its maximum inner volume in step 315, FIG. 1A. Once the articulating structure reaches this approximate position, the compressed mixture is optimally timed ignited for combustion in step 320. This sets the articulating structure into motion to FIG. 1C, and the process is reversed, reverting back to the initial position in step 325. Once the articulating structure reaches the initial position, the cycle begins again at step 301. In the present embodiment, one or more connecting rods may be attached to the articulating structure to translate the reciprocating motion of the articulating structure to a connected object. A multiplicity of suitable objects may be connected to the connecting rod or rods such as, but not limited to, crankshafts, camshafts, cams, fly wheels, pistons, valves, etc. It is believed that by changing the shape of the articulating structure within the combustion chamber combustion power and efficiency may be improved. In the present invention the connecting rods are exposed in the firing chamber area 140, like the top of pistons, spark plug bottoms or valves used in a conventional ICE. The connecting rods are an integral part that are also used as a void by controlling the size of the combustion area 140. In some embodiments, the connecting rods may be used as a method to contain the combustion area 140. In some embodiments, a centralized crankshaft or camshaft may be deployed with the correct geometry and linkage to the connecting rods for internal structure reciprocating conversion to rotary motion. This design change may eliminate the need for flywheel 215 and rollers 210. In some embodiments, a flywheel may be directly attached to a crankshaft to save space. Typically, a conventional ICE's need to balance rotating masses can be quite tricky because of their design geometry and their unbalanced symmetry. Embodiments of the present invention may provide for a balanced symmetry. The ability of many embodiments of the present invention to fire all of its equivalent pistons at one time and in one stroke using a power plate configuration that also increases in size of usable service area as combustion pressures diminish, may greatly enhance a machine that incorporates its usage. Various machines such as, but not limited to, Automobile engine, Truck and bus engine, Air motor, Hydraulic motor, Water pump, Gas engine, Diesel engine, Outboard, inboard motor, generator, Vacuum pump, Gas Compressor, Robotic activation, Freon compressor Wave and tide generator, hydro power, steam motor, etc. may benefit from the present invention's methodology.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing an engine chamber comprising an articulating inner structure according to the present invention will be apparent to those skilled in the art. Various aspects of the invention have been described above by way of illustration, and the specific embodiments disclosed are not intended to limit the invention to the particular forms disclosed. The particular implementation of the engine chamber comprising an articulating inner structure may vary depending upon the particular context or application. By way of example, and not limitation, the engine chambers described in the foregoing were principally directed to implementations using the reciprocal motion or translated rotational motion as the end product; however, similar techniques may instead be applied to converting the motion into various different outputs; for example, without limitation, connecting the chamber to a turbine to produce electricity or for pumping applications, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising:

a housing comprising at least a recessed area within said housing, an inner wall and an input port to said recessed area;

a plurality of plates being disposed within said housing, said plurality of plates being configured to form a structure, said structure having an outside surface and an inside surface, said inside surface forming an inner volume, said structure being capable of being articulated between at least a first configuration and a second and third configuration;

a plurality of connecting rods being joined to said plurality plates to form said structure and to at least in part articulate said structure, said plurality of connecting rods being movable to form said first configuration to enable a gas to flow from said recessed area to said outside surface, said plurality of connecting rods being further movable to form said second configuration, wherein, in said second configuration, at least a portion of the gas is compressed between said outside surface and said inner wall;

in which said plurality of plates comprises four plates and said plurality of connecting rods comprises four connecting rods;

said first configuration generally comprises a rectangle shaped configuration and said second configuration generally comprises of a square shaped configuration and said third configuration comprises a rectangle shaped configuration; and wherein said four connecting rods are disposed as opposing pairs.

2. The apparatus as recited in claim 1, further comprising a flywheel having an internal eccentric continuous lobe, said internal eccentric continuous lobe being in engagement with at least one of said connecting rods.

3. The apparatus as recited in claim 2, in which a half rotation of said flywheel completes two strokes of the apparatus.

4. The apparatus as recited in claim 1, further comprising at least one exhaust port being configured to release at least a portion of the compressed gas outside of said housing.

5. The apparatus as recited in claim 4, further comprising at least one port configured for receiving an igniter for igniting the compressed gas, wherein said igniter is selected from the group comprising a sparkplug and a glow plug.

6. The apparatus as recited in claim 1, further comprising rollers joined to said connecting rods for engaging an internal eccentric continuous lobe.

7. The apparatus as recited in claim 1, further comprising wrist pins for joining said plates to said connecting rods.

8. A method comprising:

articulating a structure to a first configuration, said structure comprised of a plurality of plates, said structure having an outside surface and being disposed within a housing, said housing having at least a recessed area within said housing, an inner wall and an input port to said recessed area, said plates being joined to a plurality of connecting rods being movable to form said first configuration, wherein a gas flows from said recessed area to said outside surface;

articulating said structure to a second configuration, wherein at least a portion of the gas is compressed between said outside surface and said inner wall in which said plurality of plates comprises four plates and said plurality of connecting rods comprises four connecting rods;

in which said articulated structure generally starts as a vertically oriented rectangle configuration and opens to a square configuration, and then to a horizontally oriented rectangle configuration and then reverse back to said square configuration and then back to said vertically oriented rectangle configuration; and in which said connecting rods are disposed as opposing pairs.

9. The method as recited in claim 8, in which said connecting rods are in engagement with an internal eccentric continuous lobe of a flywheel.

10. The method as recited in claim 8, in which at least a portion of the compressed gas is released outside of said housing.

11. The method as recited in claim 10, further comprising igniting the compressed gas.

12. An apparatus comprising:

a housing comprising at least a recessed area within said housing, an inner wall and an input port to said recessed area;

at least four plates being disposed within said housing, said plates being configured to form a structure, said structure having an outside surface and an inside surface, said inside surface forming an inner volume, said structure being capable of being articulated between at least a first configuration, and a second and third configuration at least four connecting rods being joined to said plates to form said structure and to at least, in part, articulate said structure in which said connecting rods are disposed as opposing pairs, said connecting rods being movable to form said first configuration to enable a gas to flow from said recessed area to said outside surface, said connecting rods being further movable to form said second configuration, wherein, in said second configuration, at least a portion of the gas is compressed between said outside surface and said inner wall;

wrist pins for joining said plates to said connecting rods;

a flywheel having an internal eccentric continuous lobe, said internal eccentric continuous lobe being in engagement with at least one of said connecting rods in which an orientation of said first configuration alternates between a generally vertical position and a generally horizontal position;

rollers joined to said connecting rods for engaging said internal eccentric continuous lobe;

at least one exhaust port being configured to release at least a portion of the compressed gas outside of said housing; and at least one spark plug port being configured for receiving an igniter for igniting the compressed gas.

* * * * *